US008978339B2

(12) United States Patent
Doupe et al.

(10) Patent No.: US 8,978,339 B2
(45) Date of Patent: Mar. 17, 2015

(54) ADJUSTABLE JOIST HANGER

(71) Applicant: Klevaklip Systems Pty Ltd., Cromer NSW (AU)

(72) Inventors: Greg James Doupe, Cromer NSW (AU); Stephen Ley Sanders, Cromer NSW (AU)

(73) Assignee: Klevaklip Systems Pty Ltd., Cromer NSW (AU)

( * ) Notice: Subject to any disclaimer, the term of this patent is extended or adjusted under 35 U.S.C. 154(b) by 0 days.

(21) Appl. No.: 14/098,253

(22) Filed: Dec. 5, 2013

(65) Prior Publication Data

US 2014/0182236 A1 Jul. 3, 2014

(30) Foreign Application Priority Data

Dec. 6, 2012 (AU) ..... 2012261552

(51) Int. Cl.
*E04B 1/38* (2006.01)
*E04B 1/26* (2006.01)

(52) U.S. Cl.
CPC ..... *E04B 1/38* (2013.01); *E04B 1/2612* (2013.01)
USPC ..... 52/705; 52/702; 52/92.2

(58) Field of Classification Search
CPC ... E04B 1/2608; E04B 1/2612; E04B 1/4178; E04B 2001/2684; E04B 7/045; E04B 1/38
USPC ..... 52/92.1, 92.2, 702, 703, 705, 712, 713
See application file for complete search history.

(56) References Cited

U.S. PATENT DOCUMENTS

| | | | | | |
|---|---|---|---|---|---|
| 4,124,962 | A * | 11/1978 | Lancelot et al. | ..... | 52/702 |
| 4,158,940 | A * | 6/1979 | Lancelot et al. | ..... | 52/702 |
| 4,348,002 | A * | 9/1982 | Eyden | ..... | 249/19 |
| 6,931,813 | B2 * | 8/2005 | Collie | ..... | 52/713 |
| 2002/0078657 | A1 * | 6/2002 | Zambelli et al. | ..... | 52/710 |
| 2008/0172976 | A1 * | 7/2008 | Carney et al. | ..... | 52/702 |

* cited by examiner

*Primary Examiner* — Brian Glessner
*Assistant Examiner* — Adam Barlow
(74) *Attorney, Agent, or Firm* — Lando & Anastasi, LLP

(57) ABSTRACT

An adjustable joist hanger including a mounting foot having a substantially planar lower abutment surface, the mounting foot having at least one attachment opening to attach the mounting foot relative to a surface and at least one, at least partially threaded member extending therefrom, a substantially U-shaped joist carrier adapted to receive a portion of a joist and mounted for movement relative to the at least one, at least partially threaded member and an adjustment mechanism for adjusting the joist carrier relative to the mounting foot.

18 Claims, 8 Drawing Sheets

ADJUSTABLE JOIST HANGER

CROSS-REFERENCE TO RELATED APPLICATION

This application claims priority under 35 U.S.C. §119(a)-(d) to Australian Patent Application No. AU 2012261552, filed on Dec. 6, 2012, which is hereby incorporated by reference.

TECHNICAL FIELD

The present invention relates generally to building or construction and particularly to an adjustable joist hanger.

BACKGROUND ART

Typically, when a construction such as a floor or deck is to be built over a concrete foundation or on upstanding posts, normally, a concrete pad is poured into which is fitted a metal post stirrup bracket.

Conventional post stirrup brackets include an elongate upstand with a U-shaped receiving channel at an upper end and a substantially planar foot at a lower end. The foot and a portion of the elongate upstand are located in the fresh concrete and the stirrup bracket is maintained in position while concrete goes off. This fixes the stirrup bracket in position and into which a post or joist can be laid for supporting the remainder of the floor or deck.

Due to the nature of this post stirrup bracket, it is important that the correct height and/or level in relation to the finished concrete is maintained while the concrete goes off otherwise the post or joist will be in the wrong position or have the wrong orientation.

It would therefore be of use to the art if an adjustable stirrup bracket or joist hanger were provided allowing adjustment of the joist or post to ensure the correct level and/or orientation of the joist or post.

It will be clearly understood that, if a prior art publication is referred to herein, this reference does not constitute an admission that the publication forms part of the common general knowledge in the art in Australia or in any other country.

SUMMARY OF INVENTION

The present invention is directed to an adjustable joist hanger, which may at least partially overcome at least one of the abovementioned disadvantages or provide the consumer with a useful or commercial choice.

With the foregoing in view, the present invention in one form, resides broadly in an adjustable joist hanger including a mounting foot having a substantially planar lower abutment surface, at least one attachment opening to attach the mounting foot relative to a surface and at least one, at least partially threaded member extending therefrom, a substantially U-shaped joist carrier adapted to receive a portion of a joist and mounted for movement relative to the at least one, at least partially threaded member and an adjustment mechanism for adjusting the joist carrier relative to the mounting foot.

In an alternative form, the invention resides in a mounting foot for use in an adjustable joist hanger, the mounting foot including a body with a substantially planar lower abutment surface, at least one attachment opening to attach the mounting foot relative to a surface at least one opening therethrough with a shaped periphery in order to allow passage of an at least partially threaded member therethrough but prevent passage of an enlarged head member of the threaded member, the shaped periphery such that the enlarged head member is recessed within the shaped periphery so as not to interrupt the substantially planar lower abutment surface and at least one attachment portion to allow attachment of the mounting foot relative to a surface.

In yet another form, the invention resides in a joist carrier adapted to receive a portion of a joist and to be mounted adjustably relating to a mounting foot which is in turn mounted relative to a surface, the joist carrier having a substantially U-shaped body and at least one mounting wing adapted to engage with an adjustment mechanism associated with the mounting foot for adjusting the joist carrier relative to the mounting foot.

For the purposes of the present discussion, in architecture and engineering, a joist is one of the horizontal supporting members that run from wall to wall, wall to beam, or beam to beam to support a ceiling, roof, or floor. It may be made of any material but typically is made from oriented strand board, plywood, wood, steel, or concrete. Typically, a beam is bigger than, and is thus distinguished from, a joist. Joists are often supported by beams and are usually repetitive. Although entitled an "adjustable joist hanger", the joist hanger of the present invention is also adapted to receive a post therein and use of the phrase "joist carrier" can be read as including use of the apparatus to carry a post rather than a joist.

The joist hanger of the present invention is normally mounted substantially permanently relative to a support surface or structure which, in a particularly preferred form, is or includes a concrete pad or slab. A number of joist hangers can be used to mount joists relative to a unitary slab or alternatively, a single joist hanger can be used on a separate concrete foot which is independent and separate from other concrete feet also mounting a joist hanger.

Typically, the joist hanger of the present invention is used to mount a wooden joist or post but the joist hanger may be used to attach joists or posts of other materials such as metal.

The joist hanger of the present invention is adjustable in a number of different directions and is preferably the position of the joist carrier relative to the mounting foot can be adjusted in height or separation distance as well as in angle with the pitch and/or roll directions of the joist carrier being adjustable. It is preferred that the yaw direction not be adjustable, but this may be desired in particular circumstances depending upon the features of the adjustment mechanism provided.

One adjustable joist hanger of the present invention may be used per joist or post but typically, more than one adjustable joist hanger of the invention will be used for each joist (which are normally elongate and extend substantially horizontally) and a single adjustable joist hanger will be used for each upstanding post. However, the joist hanger of the present invention can be used in any orientation to provide adjustability.

The adjustable joist hanger of the present invention includes a mounting foot. Typically, only one mounting foot is provided, but it is anticipated that according to the invention, more than one mounting foot could be used to mount the joist carrier. In particular, one mounting foot could be used for each partially threaded member extending therefrom. However, it is preferred that a single, unitary mounting foot is provided for each joist carrier as this will simplify installation and minimise errors in positioning and alignment.

Typically, each mounting foot is manufactured from a robust material such as metal and will typically be galvanised in order to withstand the rigours of installation and time in position. Any material may be used that is suitable for the purpose however.

Preferably, each mounting foot is a substantially planar, unitary plate. One or more strengthening ribs or elements may be provided on the mounting foot. Where provided, the strengthening ribs or elements are typically arcuate and elongate extending over a portion of the mounting foot.

Normally, each mounting foot will have at least one attachment opening extending through the mounting foot. It is preferred that a single attachment opening is provided approximately centrally across the width and length of the mounting foot. It is further preferred that the attachment opening is and elongate slot opening in order to provide adjustment in the positioning of the mounting foot. Preferably, the elongate slot opening is oriented across the width of the plate, that is, perpendicularly to the direction of the joist and the side walls of the joist carrier. More than one attachment opening may be provided.

Each attachment opening will typically receive an elongate fastener used to fix the mounting foot relative to the support. The type of elongate fastener used will depend upon the support and will be chosen appropriately.

The lower surface of the mounting foot is substantially planar in order to abut the support surface. However, it is anticipated that the lower surface may not be in a single plane. For example, an L-shaped or Z-shaped mounting foot may be provided in order to mount joists relative to an edge of a slab for example.

The mounting foot includes at least one and typically a pair of openings, each with a shaped lower periphery. Normally, a pair of openings is provided, one on each side of the mounting foot.

The shaped lower periphery is typically provided as a recess or depression in or into an underside of the mounting foot, about the opening. Therefore, an elevated portion may be formed on an upper side of the mounting foot. The shaped lower periphery is typically formed by deforming a substantially planar plate upwardly in the shape required to form a recess on a lower side and an elevated portion on an upper side, through which the opening extends.

The recess or depression is typically shaped, and preferably shaped to receive an enlarged head portion of an upstanding fastener provided through the opening. The enlarged head is preferably received within the recess such that the lower surface of the mounting foot is uninterrupted. Therefore, the enlarged head of the preferred fastener is preferably completely received within the recess. In some embodiments, the end of the enlarged head may be coplanar with the substantially planar lower surface and in some embodiments, stand slightly proud of the substantially planar lower surface of the mounting foot.

Preferably, the recess is shaped to closely receive the enlarged head portion of fastener. It is preferred that the shaped lower periphery prevents rotation of the fastener due to the periphery of the recess typically abutting the enlarged head of the fastener which is normally shaped in order to engage a tool. Therefore, the periphery of the recess will normally be shaped to correspond with the head of the fastener used.

Alternatively, the fastener may be fixed relative to the recess using a suitable method such as welding or the like.

The opening provided is typically provided through the shaped periphery, normally centrally. The opening may have any shape. However, the opening is typically circular in order to correspond with the shape of most fasteners but the opening may correspond to the shape of the shaft of the fastener if it is other than circular.

The joist carrier of the adjustable joist hanger of the present invention preferably has a substantially U-shaped body. The preferred U-shaped body defines a receiving channel in order to receive a joist or post. Where a joist is received, the joist typically extends substantially perpendicularly to the mounting foot.

As with the mounting foot, the joist carrier is typically manufactured from metal, but any material can be used. Normally, where metal is used, the metal is again galvanised similarly to the mounting foot.

Preferably, the joist carrier includes a basewall with a pair of upstanding side walls. Normally, the base wall and side walls are integrally formed, normally by deforming or bending a substantially planar plate. The side walls typically extend substantially perpendicularly to the base wall, and are normally oriented in an upwardly extending direction. The preferred shape of the joist carrier is such that it closely receives a post or joist of a particular dimension. The dimensions of joist or posts are typically standardised and therefore, the joist carrier will normally be manufactured to receive one of these standardised posts or joists.

At least one and typically a number of openings are provided in each side wall of the joist carrier through which fasteners such as nails or screws can be placed in order to fix the post or joist relative to the joist carrier. Openings of different sizes can be provided over the same side wall.

Normally, one or more strengthening ribs or elements may be provided in or on the joist carrier and normally, in or on the base wall. Where provided, the strengthening ribs or elements will preferably be arcuate and protrude upwardly from the basewall and extend toward the centre of the base wall.

Raised portions may be provided to maintain the joist away from the basewall of the carrier so as to space the joist from the carrier to allow air to circulate and/or maintain the joist as dry as possible.

The joist carrier is preferably provided with a one or more adjustment wings in order to adopt the joist carrier relative to the mounting foot. Normally, a pair of adjustment wings is provided, one extending laterally outwardly from each of the side walls of the joist carrier.

Preferably, the adjustment wings are integrally formed with the joist carrier and particularly each side wall. According to a preferred form, the adjustment wings are formed by an incision in the side wall extending through the side wall and then folding a portion of the incised part outwardly to an orientation which is typically substantially perpendicular to the plane of the side wall. Normally, the adjustment wings are rounded in order to prevent or minimise damage or injury, during or after installation.

Each adjustment wing will normally have an opening therethrough in order to receive a portion of an elongate fastener such as a bolt or threaded rod or similar which will normally be upstanding from the mounting foot. Preferably, the opening is slightly larger than the dimension of the threaded rod or fastener which it receives in order to allow the joist carrier to be slidable in an unrestricted way relative to the threaded rod or fastener.

The opening is preferably shaped to correspond in shape with the threaded rod or fastener it receives. The opening will closely receive the threaded rod or fastener in order to minimise rattling or "play" of the joist carrier relative to the upstanding threaded rod.

One or more reinforcing brackets or flanges may extend between the adjustment wing and a side wall and/or base wall of the joist carrier.

Further, one or more strengthening ribs will typically be provided in the region of the fold or bend portion between the adjustment wing and the sidewall in order to minimise the chance of the formation of the wing relative to the sidewall.

Each adjustment wing will typically be approximately centrally located along the sidewall. Preferably, each adjustment wing will be located towards an upper edge of the side wall.

An adjustment mechanism is also provided in the adjustable joist hanger of the present invention. It is preferred that the adjustment mechanism be as simple as possible, yet provide effective and variable adjustment to a user. Preferably, the adjustment mechanism will adjust and also preferably fix the position of the joist carrier relative to the mounting foot.

The preferred adjustment mechanism will include at least one threaded nut to engage the threaded rod or fastener provided on each side of the joist carrier. Normally, a pair of nuts will be provided on each threaded rod or fastener, one lower support nut and an upper, locking nut. One or more washers or similar may be used in association with either or both of the nuts provided relative to each threaded rod or fastener. Typically, adjustment of the position of the lower nut will change the position and/or orientation of the joist carrier and tightening the upper, locking nut will preferably lock the joist carrier in position relative to the threaded rod or fastener unless the lower nut is loosened. Normally, the lower nut will be properly located first and then the upper nut tightened against the lower nut. One or more secondary locking nuts may be provided on either side of the support and locking nut in order to lock the position of these nuts.

According to the preferred embodiment in which a pair of upstanding threaded rods or fasteners is provided on each mounting foot, typically four nuts, two on each fastener, one upper and one lower. As mentioned previously, the upstanding threaded rods or fasteners will typically be in the form of bolts with a shaped head and an elongate shank having at least a threaded portion, although the majority of the shank may be threaded. Typically, the most common bolts will be used which have hexagonal heads but the head can be any shape. Normally, the bolts and nuts and any washers used will also be galvanised in order to minimise or prevent any corrosion or weakening of the structure.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

DESCRIPTION OF EMBODIMENTS

Figure 1:
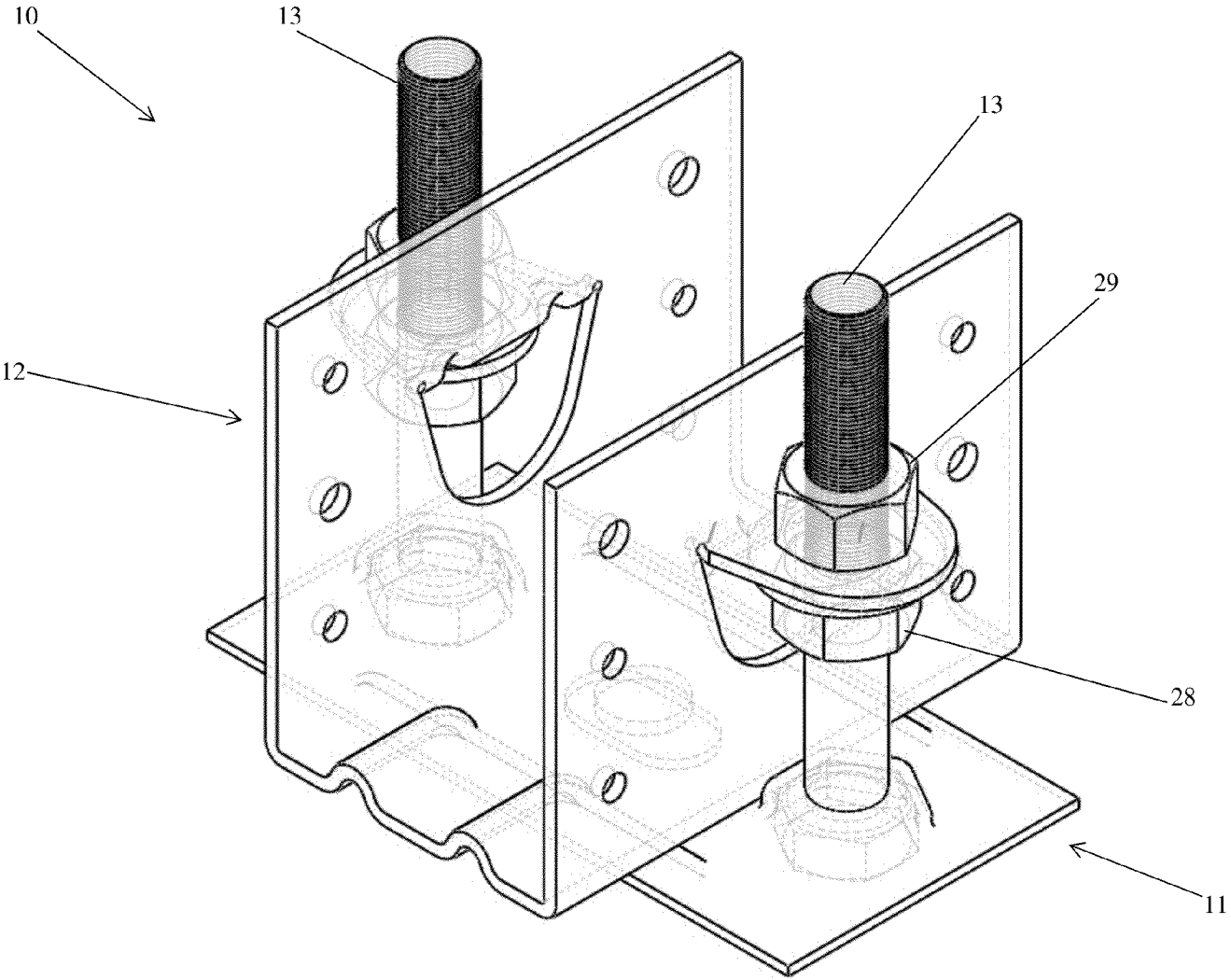
FIG. 1 is an isometric view of an adjustable joist hanger according to a particularly preferred embodiment of the present invention.

According to a particularly preferred embodiment of the present invention, an adjustable joist hanger and method of use is provided.

The adjustable joist hanger 10 illustrated in the Figures includes a mounting foot 11 having a substantially planar lower abutment surface. The mounting foot has a pair of bolts 13 having partially threaded shanks extending upwardly therefrom. A substantially U-shaped joist carrier 12 adapted to receive a portion of a joist (illustrated in FIGS. 10 to 15) is mounted for movement relative to the pair of bolts 13 and an adjustment mechanism is provided for adjusting the position and orientation of the joist carrier 12 relative to the mounting foot 11.

The mounting foot 11 of the preferred embodiment is illustrated in FIGS. 6 to 9 in particular and includes a plate 14 with a substantially planar lower abutment surface and an attachment opening 15 therethrough to allow attachment of the mounting foot 11 relative to a surface as illustrated in FIGS. 10 to 15. A pair of openings 16 is provided, each with a shaped periphery 17 in order to allow passage of an at least partially threaded shank of a bolt therethrough but prevent passage of an enlarged head of the bolt. The shaped periphery 17 is such that the enlarged head of the bolt is recessed within the shaped periphery 17 so as not to interrupt the substantially planar lower abutment surface of the mounting foot 11.

According to the illustrated embodiment, each mounting foot 11 is a substantially planar, unitary plate 14. A pair of strengthening ribs 18 is provided on the mounting foot 11. The strengthening ribs 18 are typically arcuate and elongate extending over a portion of the mounting foot 11 substantially parallel to the longer dimension of the attachment opening or transversely to the direction of the joist.

Figure 6:
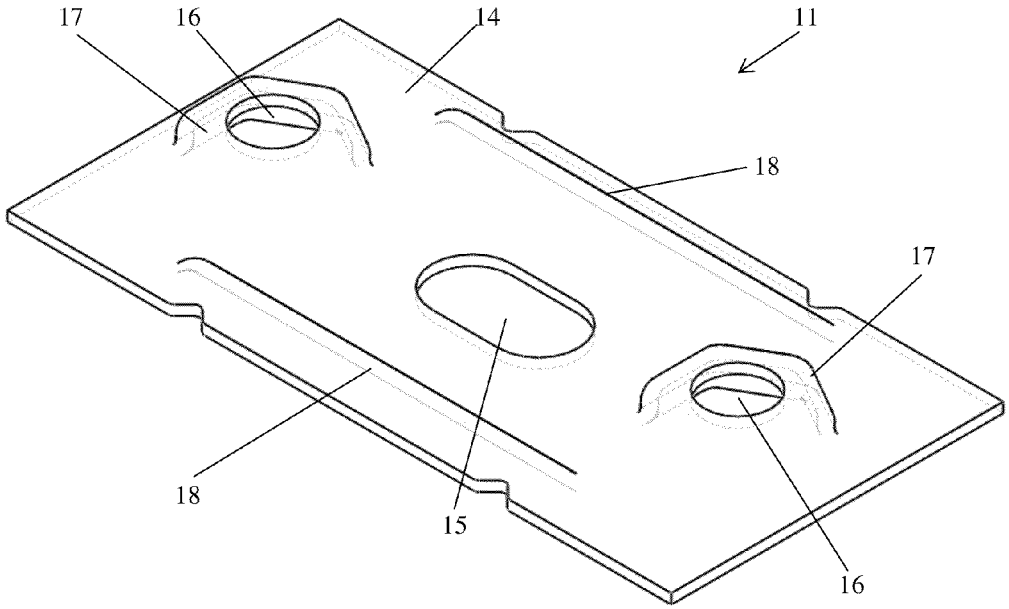
FIG. 6 is an isometric view of a mounting foot of an adjustable joist hanger according to a particularly preferred embodiment of the present invention.
Figure 7:
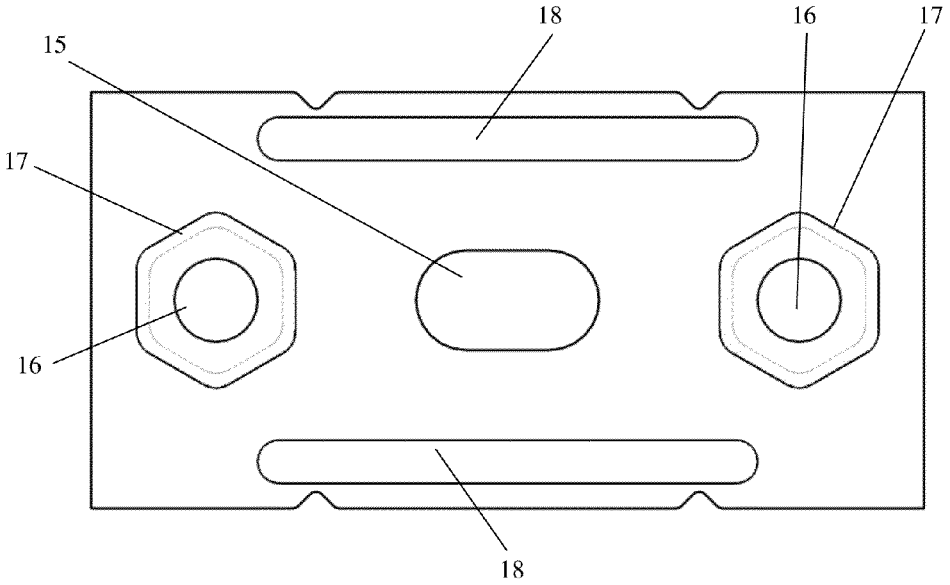
FIG. 7 is a plan view of the mounting foot illustrated in FIG. 6.
Figure 8:
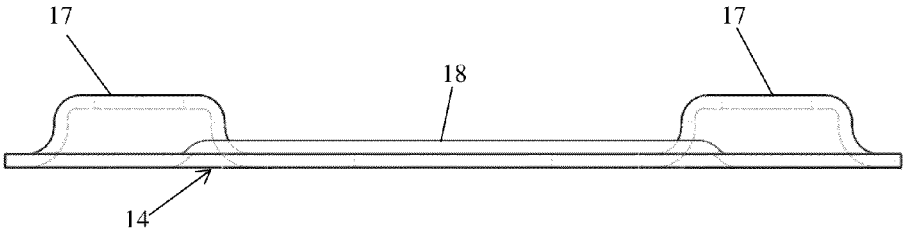
FIG. 8 is an end elevation view of the mounting foot illustrated in FIG. 6.
Figure 9:
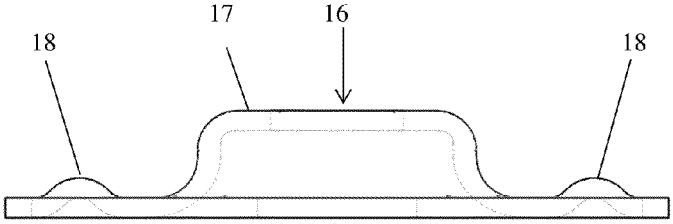
FIG. 9 is a side elevation view of the mounting foot illustrated in FIG. 6.
Figure 12:
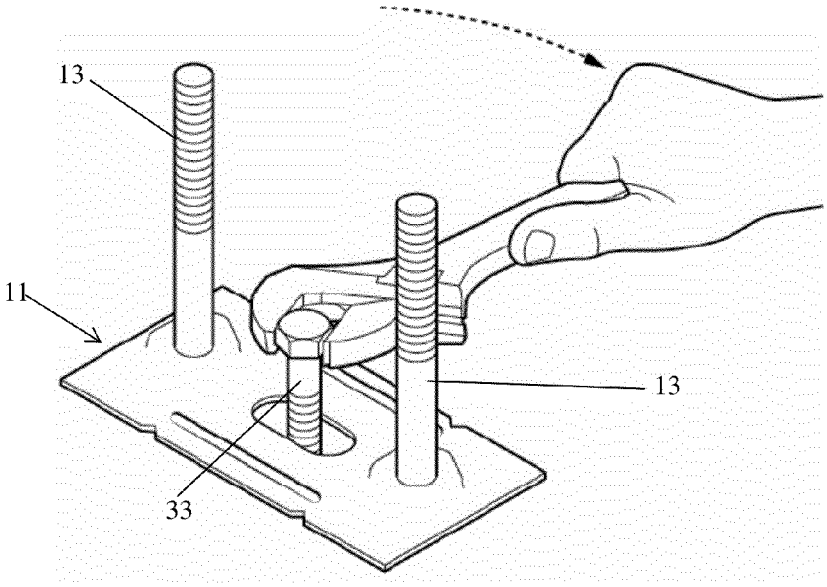
FIG. 12 illustrates a fourth step in a preferred method for use of the adjustable joist hanger of the preferred embodiment of the present invention.

As illustrated in FIG. 6, the preferred attachment opening 15 is provided approximately centrally across the width and length of the mounting foot 11 and is configured as an elongate slot opening in order to provide adjustment in the positioning of the mounting foot 11. As illustrated in FIG. 12, the attachment opening 15 receives an elongate fastener used to fix the mounting foot 11 relative to the support.

The shaped periphery 17 of the openings 16 is provided as a recess or depression in or into an underside of the mounting foot, about the opening 16. According to the preferred method of forming the shaped periphery which is by deforming a substantially planar plate upwardly in the shape required, a recess is formed on a lower side and an elevated portion on an upper side, through which the opening extends.

As illustrated in FIG. 1, the recess or depression on the lower side of the mounting foot 11 is shaped to receive an enlarged head portion of an upstanding bolt provided through the opening 16. The enlarged head is received within the recess such that the lower surface of the mounting foot is uninterrupted. Therefore, the enlarged head of the preferred fastener is preferably completely received within the recess.

Further, the recess is shaped to closely receive the enlarged head portion of the bolt and prevents rotation of the fastener due to the periphery of the recess abutting the enlarged head of the bolt which is normally shaped in order to engage a tool. Therefore, the periphery of the recess is shaped to correspond with the head of the fastener used.

The opening 16 is provided through the shaped periphery 17 normally centrally and corresponds to the shape of the shaft of the bolt.

The joist carrier 12 of the preferred embodiment is illustrated in FIGS. 2 to 5. The preferred joist carrier 12 is adapted to receive a portion of a joist and to be mounted adjustably relating to the mounting foot 11 which is in turn mounted relative to a surface. The illustrated joist carrier 12 has a substantially U-shaped body and a pair of mounting wings 24, each adapted to engage with an adjustment mechanism associated with the mounting foot 11 for adjusting the joist carrier 12 relative to the mounting foot 11.

The preferred U-shaped body defines a receiving channel 19 in order to receive a joist or post. Where a joist is received, the joist typically extends substantially perpendicularly to the mounting foot.

The joist carrier 12 illustrated in FIGS. 2 to 5 includes a basewall 20 with a pair of upstanding side walls 21. Normally, the base wall 20 and side walls 21 are integrally formed by deforming or bending a substantially planar plate. The side walls 21 extend substantially perpendicularly to the base wall 20, and are normally oriented in an upwardly extending direction.

Figure 2:
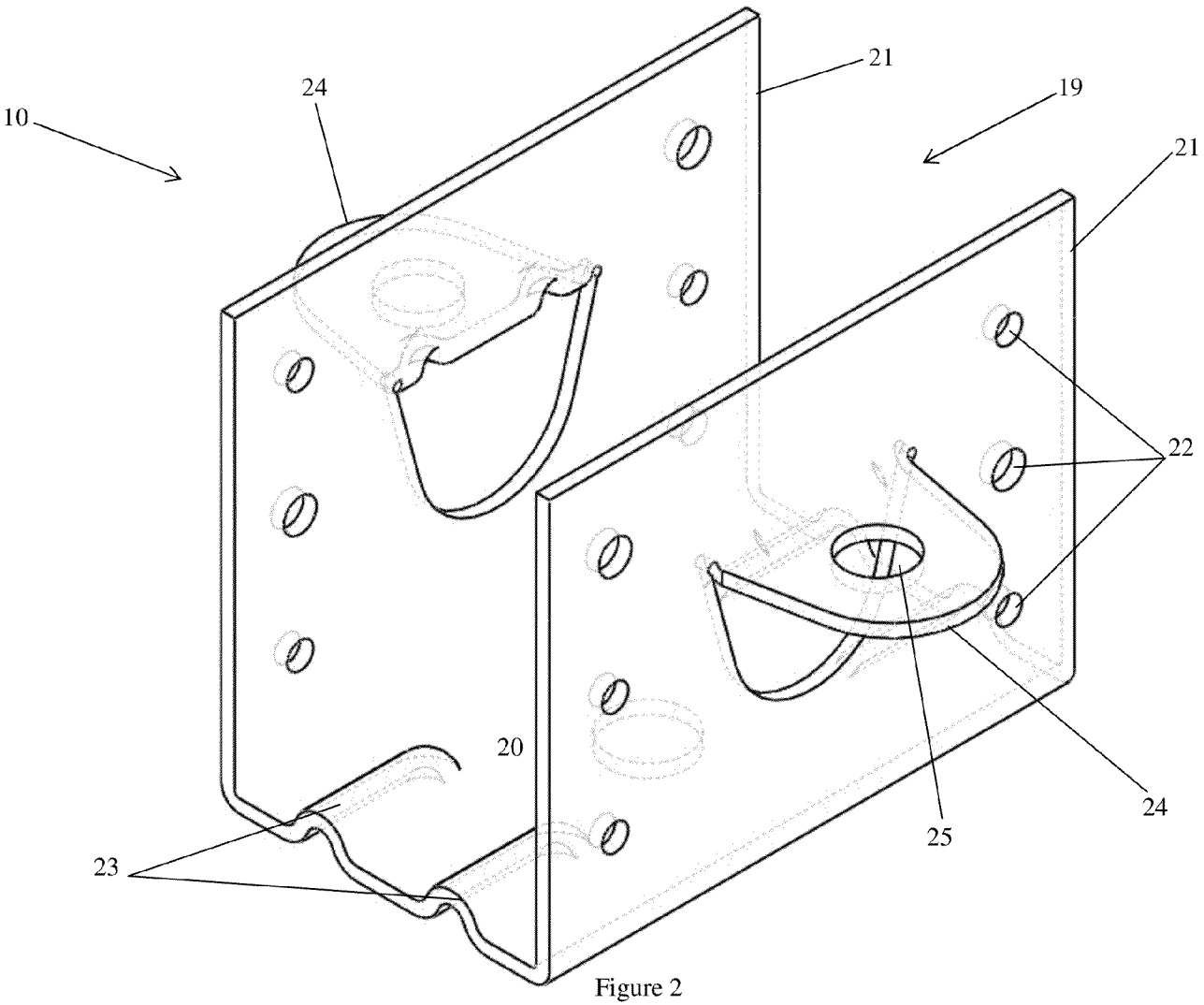
FIG. 2 is an isometric view of a joist carrier according to a particularly preferred embodiment of the present invention.
Figure 3:
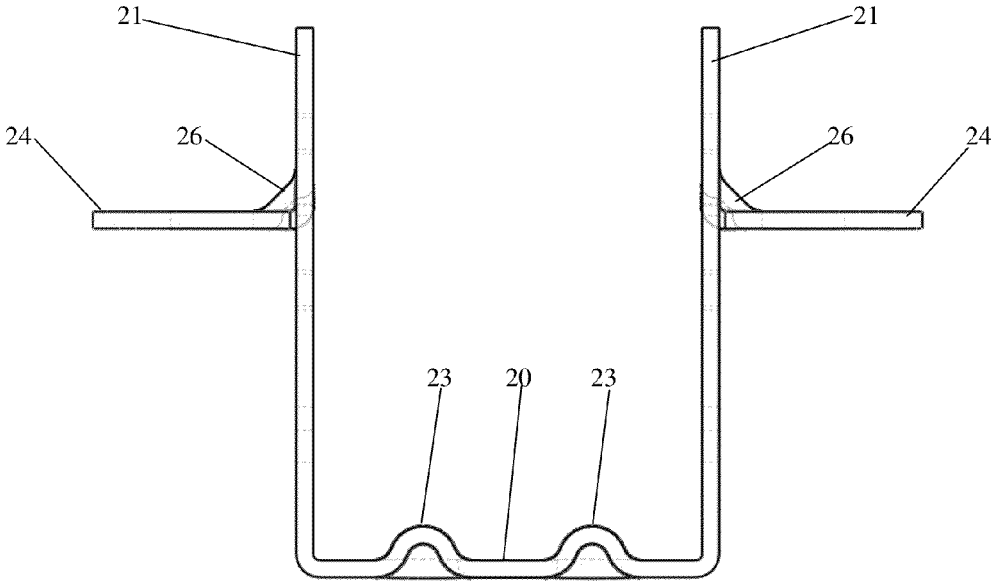
FIG. 3 is an end elevation view of the joist carrier illustrated in FIG. 2.
Figure 4:
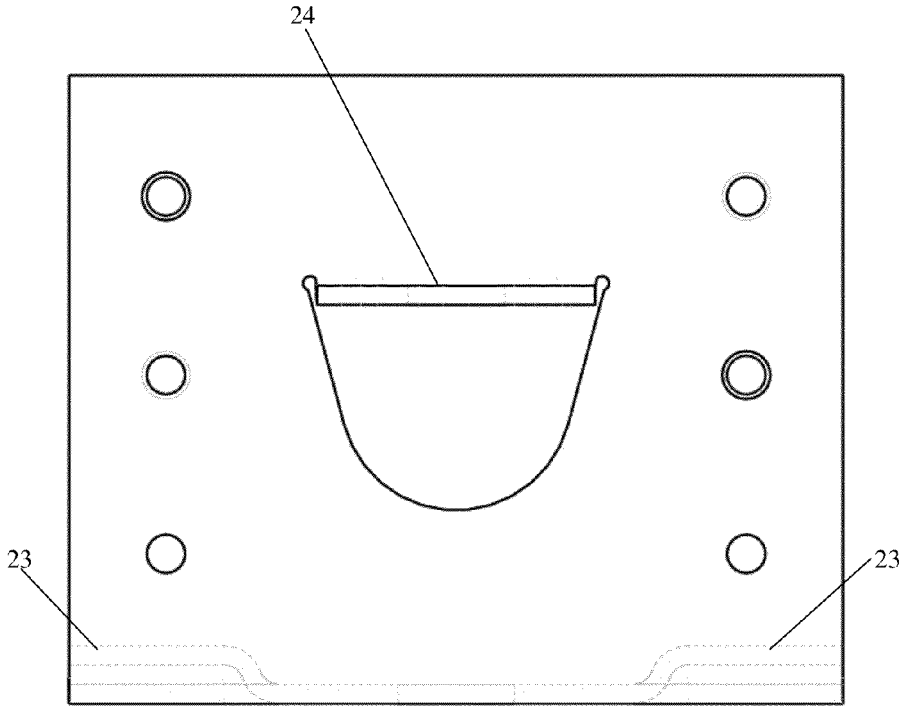
FIG. 4 is a side elevation view of the joist carrier illustrated in FIG. 2.
Figure 5:
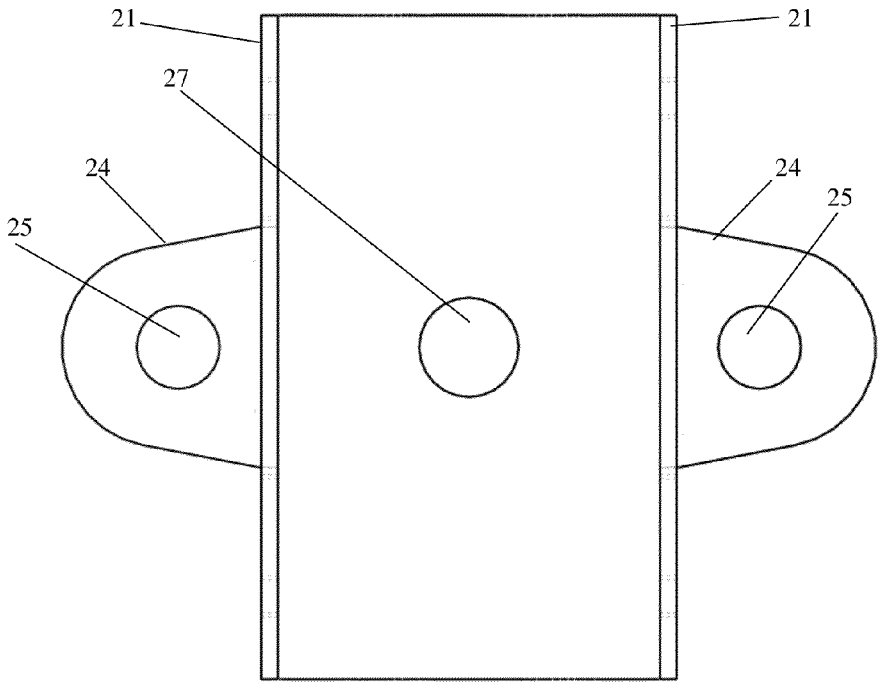
FIG. 5 is a plan view of the joist carrier illustrated in FIG. 2.
Figure 14:
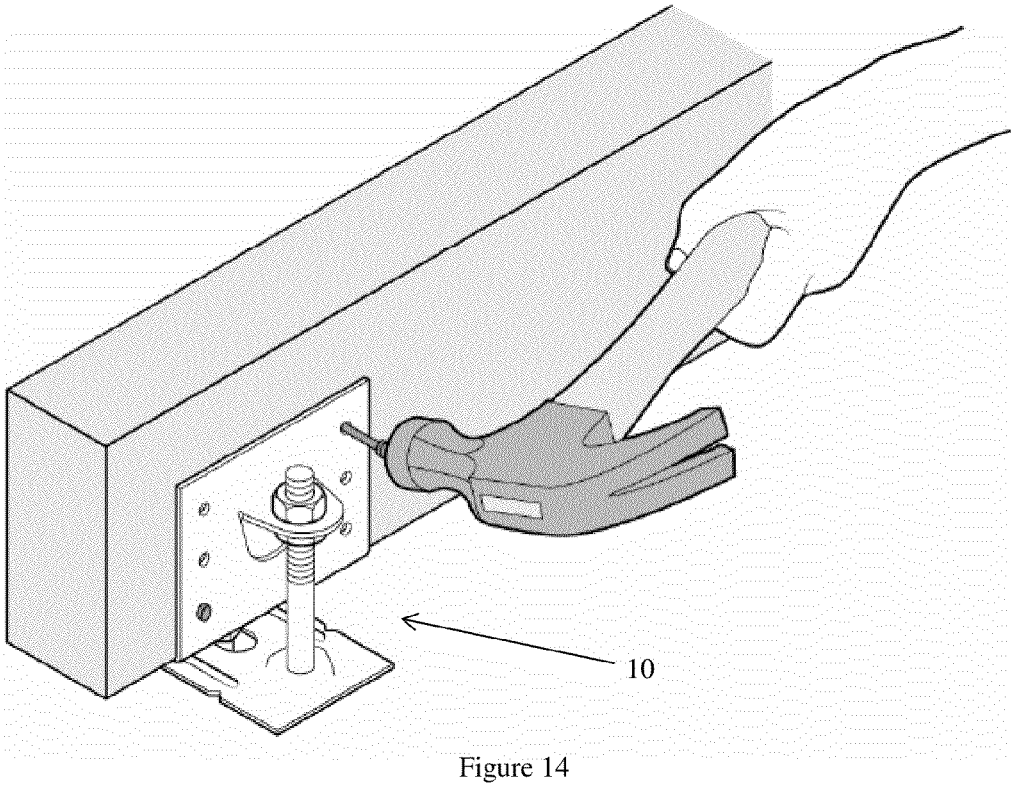
FIG. 14 illustrates a sixth step in a preferred method for use of the adjustable joist hanger of the preferred embodiment of the present invention.

A number of openings 22 are provided in each side wall 21 of the joist carrier 12 through which fasteners such as nails or screws can be placed in order to fix the post or joist relative to the joist carrier as illustrated in FIG. 14. As illustrated in FIG. 2, openings of different sizes can be provided over the same side wall 21.

Normally, a pair of strengthening ribs 23 is provided in or on either end of the base wall 20 which are arcuate and protrude upwardly from the basewall 20 extending toward the centre of the base wall 20. The ribs provided alternatively maintain the joist away from the basewall of the carrier so as to space the joist from the carrier to allow air to circulate and/or maintain the joist as dry as possible.

Each of a pair of adjustment wings 24 extend laterally outwardly from one of the side walls 21 of the joist carrier 12.

As illustrated, the adjustment wings 24 are integrally formed with the joist carrier 12 and according to a preferred form, the mounting wings 24 are formed by an incision through the side wall 21 and then folding a portion of the incised part outwardly to an orientation which is typically substantially perpendicular to the plane of the side wall 21. Normally, the mounting wings 24 are rounded in order to prevent or minimise damage or injury, during or after installation.

Each adjustment wing 24 has an opening 25 therethrough in order to receive a portion of the elongate bolt 13 which is upstanding from the mounting foot 11. The opening 25 is slightly larger than the dimension of the bolt which it receives in order to allow the joist carrier 12 to be slidable in an unrestricted way relative to the bolt 13.

Further, a pair of strengthening ribs 26 is provided in the region of the fold or bend portion between the adjustment wing 24 and the sidewall 21 in order to minimise the chance of the formation of the wing 24 relative to the sidewall 21.

Each adjustment wing will typically be approximately centrally located along the sidewall. Preferably, each adjustment wing will be located towards an upper edge of the side wall.

In the illustrated embodiment, a central attachment opening 27 is provided in the base wall 20 of the joist carrier 12 in order to allow attachment of the joist carrier 12 directly to a support without use of a mounting foot 11.

The preferred adjustment mechanism allows adjustment and also fixing the position of the joist carrier 12 relative to the mounting foot 11.

The preferred adjustment mechanism includes a pair of threaded nuts to engage each bolt 13 provided on each side of the joist carrier 12, namely a lower support nut 28 and an upper, locking nut 29. One or more washers 30 can be used in association with either or both of the nuts provided relative to each bolt 13. Adjustment of the position of the lower nut 28 changes the position and/or orientation of the joist carrier 12 and tightening the upper, locking nut 29 preferably locks the joist carrier 12 in position relative to the bolt 13 unless the lower nut 28 is loosened. In practice, the lower nut 28 is generally properly located first and then the upper nut 29 tightened against the lower nut 28.

Figure 10:
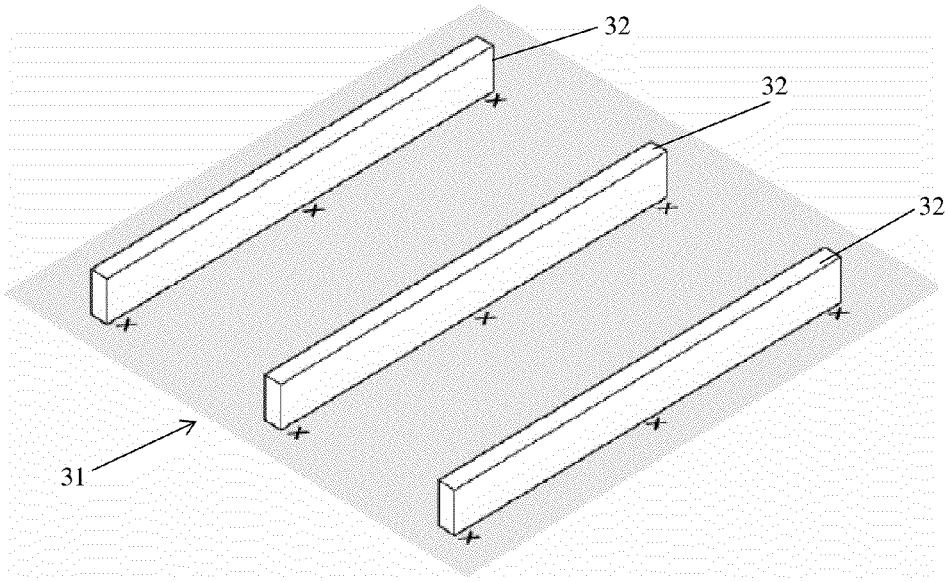
FIG. 10 is an isometric view of a first step in a preferred method for use of the adjustable joist hanger of the preferred embodiment of the present invention.

Beginning at FIG. 10 is a particularly preferred series of steps for installation of the adjustable joist hanger 10 of the preferred embodiment for building a deck over a concrete slab 31.

FIG. 10 illustrates the first step of positioning the joist hanger mounting feet or base plates relative to the concrete slab 31. Firstly, the joists 32 are laid out in position on the top of the concrete slab 31 and the positions of the mounting feet or base plates are marked out. The joist hanger of the preferred embodiment has been independently tested to support a load bearing capacity of at least 300 kg/m$^2$ (the minimum required by the relevant Australian Standard) and possibly as high as 1200 kg/m$^2$ when the particular size joist hangers used at the recommended joist spans listed in the following table which identify both recommended and minimum span requirements for both 90 mm and 70 mm joists. The span requirements for mounting foot positioning are all based on "continuous span" with joists at 450 mm separation between centres.

| Joist Hanger size | Recommended Span (mm) | Maximum Span (mm) |
|---|---|---|
| 70 × 45 mm MGP10 | 800 | 1200 |
| 90 × 45 mm | 1000 | 1500 |
| 70 × 45 mm | 1000 | 1500 |
| 90 × 45 mm | 1400 | 1800 |

The second step in the installation method is not illustrated but is directed towards drilling holes into the concrete slab 31 to allow the mounting feet or base plates to be attached to the slab. Typically, a hammer drill using a 12 mm masonry bit is used for this purpose. Typically, only a single hole is needed.

Figure 11:
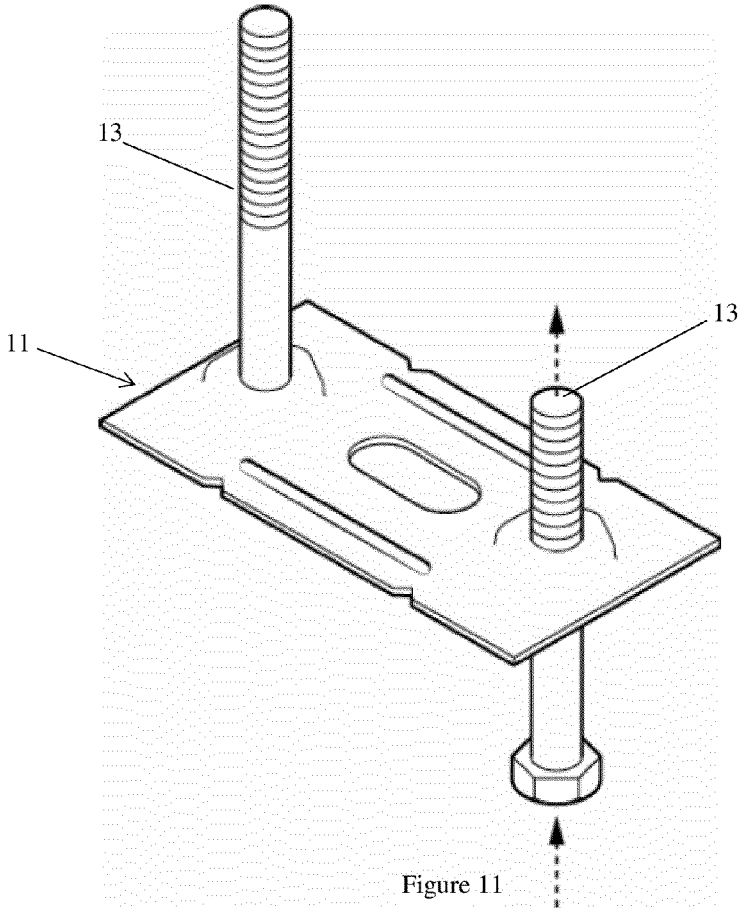
FIG. 11 illustrates a third step in a preferred method for use of the adjustable joist hanger of the preferred embodiment of the present invention.

The third step in the preferred installation method is illustrated in FIG. 11 and is the step of inserting a bolt 13, preferably with a hexagonal head through the openings 16 with the shaped periphery 17 in the mounting foot 11. The bolt 13 is inserted from the lower side of the mounting foot 11 such that it extends upwardly and the hexagonal head is received within the shaped recess on an underside of the mounting foot 11. The adjustable joist hanger of the preferred embodiment is designed to provide a "top of the joist" height from 80 mm (using 16 mm length bolts plus 70×45 mm joists) up to 170 mm (using 120 mm length bolts plus 90×45 mm joists).

The fourth step in the preferred installation method is illustrated in FIG. 12 and is the step of fixing the mounting foot 11 to the concrete slab 31. In this step, the mounting foot 11 of the adjustable joist hanger of the preferred embodiment is fixed to the concrete using a 12 mm expandable bolt 33 adapted to hold the mounting foot 11 securely relative to the concrete slab 31. In this step, it is preferred that before fully tightening the expandable bolt 33 that the upstanding bolts 13 of the joist hangers are aligned. The mounting foot can be moved through the provision of the elongate slot opening 15 in the mounting foot if minor adjustment is required. Further, it is also advisable to check that all of the mounting feet are "square" to a string line or similar which is used to align the upstanding bolts 13 and thereby align the respective joist hangers with one another.

Steps 1 to 4 are repeated for all base plates to be installed.

Figure 13:
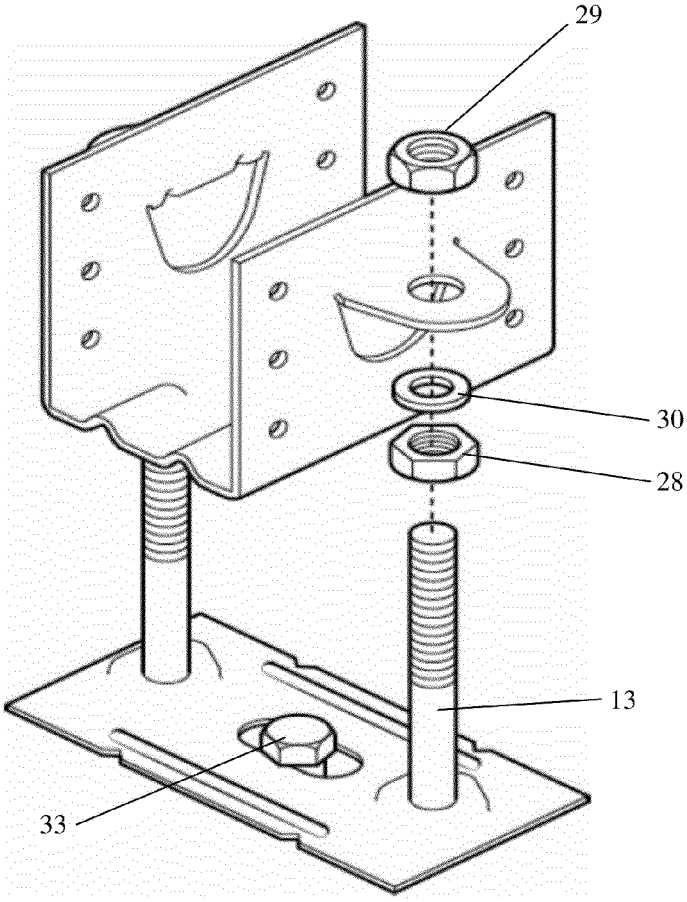
FIG. 13 illustrates a fifth step in a preferred method for use of the adjustable joist hanger of the preferred embodiment of the present invention.

Step five of the preferred installation method is illustrated in FIG. 13 and is the step of attaching the joist carrier 12 relative to the mounting foot 11. Firstly, the lower support nut 28 is threaded on to each of the upstanding bolts 13 of each mounting plate. Normally, a washer 30 is then located adjacent the lower support nut 28 and the openings 25 in the respective wings 24 of a joist carrier are aligned with the bolts 13 and the joist carrier lowered onto the bolts. In this position, the joist carrier will typically be spaced from the mounting foot 11 and held above the mounting foot 11 through the abutment of the wings 24 with the washer 30 and supported by the lower support nut 28.

Importantly, the washer used extends laterally beneath the portion of the sidewall from which the adjustment wing is folded or bent which allows the load on the hanger to be transferred more directly onto the vertical bolts, rather than the adjustment wings.

The height and orientation of the joist carrier can then be adjusted by movement of the lower support nut 28 on each of the upstanding bolts. Once the joist carrier is in position, an upper nut 29 is threaded onto the upstanding bolt 13 and is semi-tightened to sandwich the wing 24 between the upper nut 29 and the washer 30 supported by the lower support nut 28. This will prevent movement of the joist carrier particularly when the joists are inserted and secured.

FIG. 14 illustrates step 6 of the preferred installation method which is the step of inserting the joist in the hanger. The joist 32 is typically laid in position in the joist carrier and is secured with a minimum of two nails on each side of the joist carrier. The length of nails will typically vary depending upon the dimension of the joist, but it has been found that 25×3 2 mm connector nails are particularly well-suited.

Figure 15:
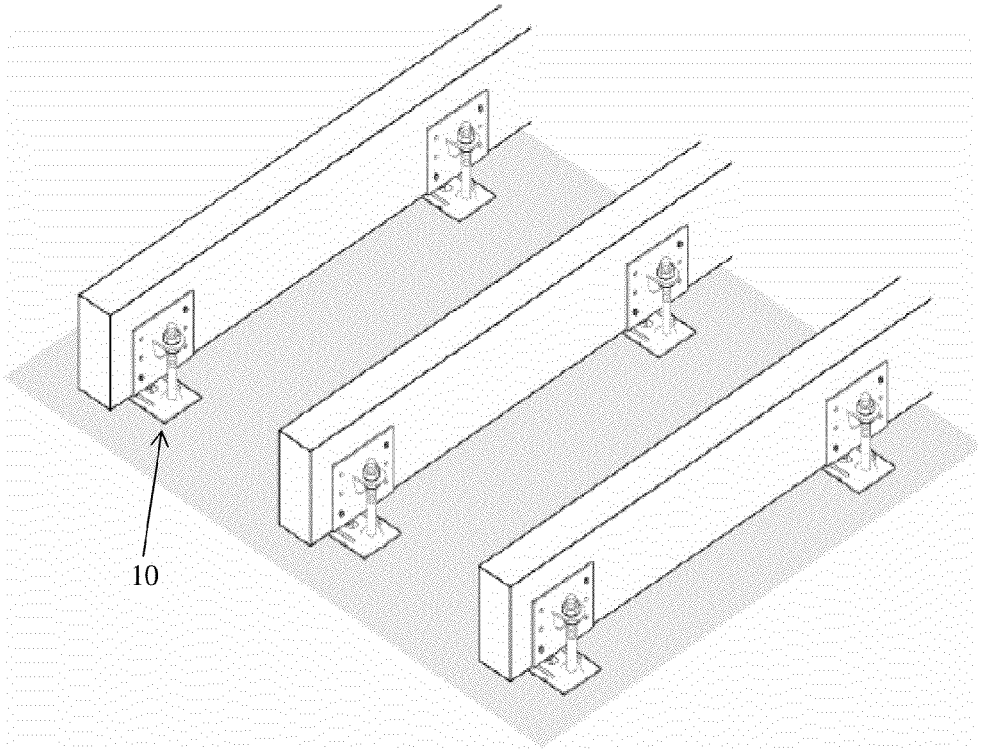
FIG. 15 illustrates a seventh step in a preferred method for use of the adjustable joist hanger of the preferred embodiment of the present invention.

FIG. 15 illustrates step seven of the preferred installation method which is the step of final adjustment of the joists 32. This is typically achieved using a dumpy level or other levelling device such as a laser level or string line. If anything other than a minor adjustment is required, the nuts retaining the wings of each respective joist carrier may require loosening. Once the joists are in the correct position and orientation, the upper nut is typically fully tightened against the wing of each of the joist carriers in order to finally fixed the position of the joist carrier relative to the mounting foot and thereby, to the concrete slab.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An adjustable joist hanger comprising:

a mounting foot having a body including a substantially planar lower abutment surface, and at least one attachment opening to attach the mounting foot relative to a surface;

at least one, at least partially threaded member mounted on the mounting foot and extending therefrom;

a substantially U-shaped joist carrier adapted to receive a portion of a joist and mounted for movement relative to the at least one, at least partially threaded member, the substantially U-shaped joist carrier having a pair of spaced apart arms, each with at least one planar mounting wing extending substantially perpendicular therefrom, the planar mounting wing having an attachment opening; and an adjustment mechanism including the at least one, at least partially threaded member received within the planar mounting wing attachment opening and at least one nut engagable with the at least one, at least partially threaded member for adjusting the joist carrier relative to the mounting foot.

2. An adjustable joist hanger as claimed in claim 1 wherein the mounting foot further includes at least one opening therethrough with a shaped periphery in order to allow passage of an at least partially threaded member therethrough but prevent passage of an enlarged head member of the threaded member, the shaped periphery such that the enlarged head member is recessed within the shaped periphery so as not to interrupt the substantially planar lower abutment surface and at least one attachment portion to allow attachment of the mounting foot relative to a surface.

3. An adjustable joist hanger as claimed in claim 2 wherein the shaped periphery is provided as a recess in or into an underside of the mounting foot, about the opening therethrough.

4. An adjustable joist hanger as claimed in claim 2 wherein an elevated portion is formed on an upper side of the mounting foot by the shaped periphery.

5. An adjustable joist hanger as claimed in claim 2 wherein the shaped periphery is formed by deforming a substantially planar plate upwardly in a shape required to form a recess on a lower side and an elevated portion on an upper side, through which the opening extends.

6. An adjustable joist hanger as claimed in claim 2 wherein the shaped periphery is shaped to receive an enlarged head portion of an upstanding fastener provided through the opening and an end of the enlarged head is coplanar with the substantially planar lower abutment surface.

7. An adjustable joist hanger as claimed in claim 6 wherein the shaped periphery is shaped to closely receive the enlarged head portion of fastener to prevent rotation of the fastener due to the periphery of the recess abutting the enlarged head of the fastener.

8. An adjustable joist hanger as claimed in claim 1 wherein the joist carrier includes a base wall with a pair of upstanding side walls.

9. An adjustable joist hanger as claimed in claim 8 wherein the base wall and side walls are integrally formed by deforming or bending a substantially planar plate.

10. An adjustable joist hanger as claimed in claim 8 wherein at least one opening is provided in each side wall of the joist carrier through which fasteners can be placed in order to fix a post or joist relative to the joist carrier.

11. An adjustable joist hanger as claimed in claim 8 wherein the joist carrier is provided with a pair of mounting wings one extending laterally outwardly from each of the side walls of the joist carrier.

12. An adjustable joist hanger as claimed in claim 1 wherein each adjustment wings is formed by an incision in a side wall extending through the side wall and then folding a portion of an incised part outwardly to an orientation which is substantially perpendicular to the side wall.

13. An adjustable joist hanger as claimed in claim 1 wherein each adjustment wing has an opening therethrough in order to receive a portion of an elongate fastener upstanding from the mounting foot.

14. An adjustable joist hanger as claimed in claim 1 wherein the adjustment mechanism includes at least one threaded nut to engage a threaded rod or fastener provided on each side of the joist carrier.

15. An adjustable joist hanger as claimed in claim 8 wherein a pair of nuts is provided on each threaded rod or fastener, one lower support nut and an upper, locking nut to clamp an adjustment wing therebetween.

16. An adjustable joist hanger as claimed in claim 1 wherein the attachment opening in the mounting foot is an elongate slot opening oriented perpendicularly to the joist.

17. An adjustable joist hanger comprising:

a mounting foot having a substantially planar lower abutment surface and at least one attachment opening to attach the mounting foot relative to a surface;

at least one, at least partially threaded member extending from the mounting foot;

a substantially U-shaped joist carrier adapted to receive a portion of a joist and mounted for movement relative to the at least one, at least partially threaded member;

an adjustment mechanism for adjusting the joist carrier relative to the mounting foot; and wherein the shaped periphery of the mounting foot is shaped to receive an enlarged head portion of an upstanding fastener provided through the opening and an end of the enlarged head is coplanar with the substantially planar lower abutment surface.

18. An adjustable joist hanger comprising:

a mounting foot having a substantially planar lower abutment surface and at least one attachment opening to attach the mounting foot relative to a surface;

at least one, at least partially threaded member extending from the mounting foot;

a substantially U-shaped joist carrier adapted to receive a portion of a joist and mounted for movement relative to the at least one, at least partially threaded member;

an adjustment mechanism for adjusting the joist carrier relative to the mounting foot; and wherein the body of the joist carrier has at least one mounting wing adapted to engage with an adjustment mechanism associated with the mounting foot for adjusting the joist carrier relative to the mounting foot, wherein the joist carrier includes a base wall with a pair of upstanding side walls, and wherein a pair of nuts is provided on each threaded rod or fastener, one lower support nut and an upper, locking nut to clamp an adjustment wing therebetween.

* * * * *